US007047879B2

(12) United States Patent
Chen

(10) Patent No.: US 7,047,879 B2
(45) Date of Patent: May 23, 2006

(54) CANTILEVER TYPE SCREEN-PRINTING MACHINE WITH DOUBLE PLATFORM

(75) Inventor: Tung-Chin Chen, Taipei Hsien (TW)

(73) Assignee: ATMA Champ Enterprise Corp., Taipei Hsien (TW)

( * ) Notice: Subject to any disclaimer, the term of this patent is extended or adjusted under 35 U.S.C. 154(b) by 72 days.

(21) Appl. No.: 10/951,659

(22) Filed: Sep. 29, 2004

(65) Prior Publication Data

US 2005/0263017 A1 Dec. 1, 2005

(30) Foreign Application Priority Data

Jun. 1, 2004 (CN) ..... 2004 1 0047348

(51) Int. Cl.
*B05C 17/05* (2006.01)

(52) U.S. Cl. ..... 101/126; 101/114

(58) Field of Classification Search ..... 101/126, 101/127, 128, 123, 114, 127.1, 128.1
See application file for complete search history.

(56) References Cited

U.S. PATENT DOCUMENTS 5,239,923 A * 8/1993 Belcher et al. ..... 101/123
5,315,929 A * 5/1994 Sundqvist ..... 101/127.1
5,343,804 A * 9/1994 Karlyn et al. ..... 101/39
5,651,308 A * 7/1997 Rohwetter et al. ..... 101/40.1
5,694,843 A * 12/1997 Chen ..... 101/123
5,784,956 A * 7/1998 Walz ..... 101/115
5,813,330 A * 9/1998 Newman ..... 101/123
6,138,560 A * 10/2000 Chen ..... 101/123
6,792,371 B1 * 9/2004 Turner ..... 702/101
6,883,425 B1 * 4/2005 Goss ..... 101/127.1

* cited by examiner

*Primary Examiner*—Anthony H. Nguyen
(74) *Attorney, Agent, or Firm*—Dennison, Schultz, Dougherty & MacDonald

(57) ABSTRACT

The present invention discloses a cantilever type screen-printing machine with double platforms that possess a gear reducer motor with a hollow shaft to rotate a screw of a threaded screw unit and further drive a threaded rod to move upward and downward without rotation inside the hollow shaft thus make a transverse sliding assembly move vertically and synchronously with the threaded rod. Moreover, by a rectangular frame and two sets of horizontal micro adjustable chase clamping mechanism transversely fixed on the rectangular frame, the relative position between the chase and the print materials is adjusted directly. The upper and the lower platforms are driven and powered by two gear reducer motors and a homocentric coaxial-type driving mechanism respectively. By the simplified driving mechanism, the printing efficiency and productivity are enhanced.

12 Claims, 10 Drawing Sheets

CANTILEVER TYPE SCREEN-PRINTING MACHINE WITH DOUBLE PLATFORM

BACKGROUND OF THE INVENTION

The present invention relates to a cantilever type screen-printing machine with double platforms, more particularly to a screen-printing machine which possess a gear reducer motor with a hollow shaft to rotate a screw of a threaded screw unit and further drive a threaded rod to move upward and downward without rotation inside the hollow shaft thus make a transverse sliding assembly move vertically and synchronously with the threaded rod. Moreover, by a rectangular frame and two sets of horizontal micro adjustable chase clamping mechanism transversely fixed on the rectangular frame, the relative position between the chase and the print materials is adjusted directly. The upper and the lower platforms are driven and powered by two gear reducer motors and a homocentric coaxial-type driving mechanism respectively. By the simplified driving mechanism, the printing efficiency and productivity are enhanced.

According to description of prior arts, double-platform screen-printing machine already exists in the categories of cantilever type screen-printing. Each platform has its own gear mechanism so that both platforms can print and process top and bottom print matters reciprocally. Furthermore, double platforms has the function of printing and managing print materials simultaneously so as to reduce the idle time of changing printing materials. Therefore concerning printing speed and productivity, it is far more better than the printing machine with a single platform, but the designation can not be too complicated in order not to increase the machine cost and space occupation. Moreover, a conventional cantilever type double-platform screen-printing machine is less efficient than a single-platform screen-printing machine in precision control of the elevating mechanism of transverse sliding assembly's vertical shifting, or the relative position (such as x, y axis pair position or z axis's horizontal degree) between the chase and the printing materials.

SUMMARY OF THE INVENTION

It is therefore a primary object of the present invention to provide a cantilever type screen-printing machine with double platforms, powered by a gear reducer motor with hollow shaft which rotates the screw of a precision threaded screw unit and drives the threaded rod to move upward and downward vertically without rotation in the hollow shaft. Then the drive transverse sliding assembly is driven synchronously with the vertical movement of the threaded rod and thus the effect of digitalized, speedy, and precise control on multiple vertical movements of the transverse sliding assembly is achieved.

It is a further object of the present invention to provide a cantilever type of double platform screen-printing machine, between the right and left cantilever arms of transverse sliding mechanism fixes a horizontal micro adjustable chase clamping mechanism which is combined from a rectangular frame with two cantilever arms, furthermore two sets of chase clamping device fix transversely on top of rectangular frame to process horizontal adjustment at right and left hand side so that the relative position (Z axis horizontal degree) between chase and print mateials can process horizontal micro adjustment.

It is a further object of the present invention to provide a cantilever type screen-printing machine with double platforms by using the power supply of two gear reducer motor, and a gear mechanism formed from the unitary coaxial inner and outer shaft to drive the upper and the lower platform to progress the reciprocal activity or single upper platform forward and backward activity of double platforms so as to minimize the gear mechanism and designed space and maximize the printing speed and the efficiency of printing productivity.

It is a further object of the present invention to provide a cantilever type screen-printing machine with double platforms, further set up X axis and Y axis platform micro adjuster on the upper an the lower platforms to make print materials on different platform matching related chase clamping by chase clamping mechanism has the function of unitary X axis or Y axis micro adjustment, or dual directions micro adjustment of X-Y axis, or ⊖ degree of circumvention adjustment for the upper and the lower platforms.

It is a further object of the present invention to provide a cantilever type screen-printing machine with double platforms, further arrange platform aspirator on the upper and the lower platforms to suck the print materials on the correct position and to avoid shifting in progress of printing.

It is a further object of the present invention to provide a cantilever type of double platform screen-printing machine, on the chase bottom arrange a scrap ink scraper device on the back edge side of the upper platform, then after chase elevating with chase clamping mechanism simutaneously the scrap ink scraper device rise scraper groove to align against the chase bottom and clear the scrap ink during the period of the upper platform perform the printing process, furthermore the scrape groove has the functionality of microadjust to precisely control the alignment of scrape groove and the surface of chase bottom.

It is a further object of the present invention to provide a cantilever type of double platform screen-printing machine, magnetic buffer is set up right behind left and right runner track respectively which combines from magnetic iron and buffer, and arrange magnetic iron and buffer opposite to each end of right and left hand side of the upper and the lower platforms respectively, so that the rapid movement of the upper and the lower platforms can be halted on printing stop position by the assistance of magnetic buffer disperse quick stop momentum by sucking, and therefore efficiently control the instant stop quake. By the way magnetic iron stop platforms use its suction force to make sure that platforms stop at the right position for each printing movement.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFFERED EMBODIMENT

Figure 1:
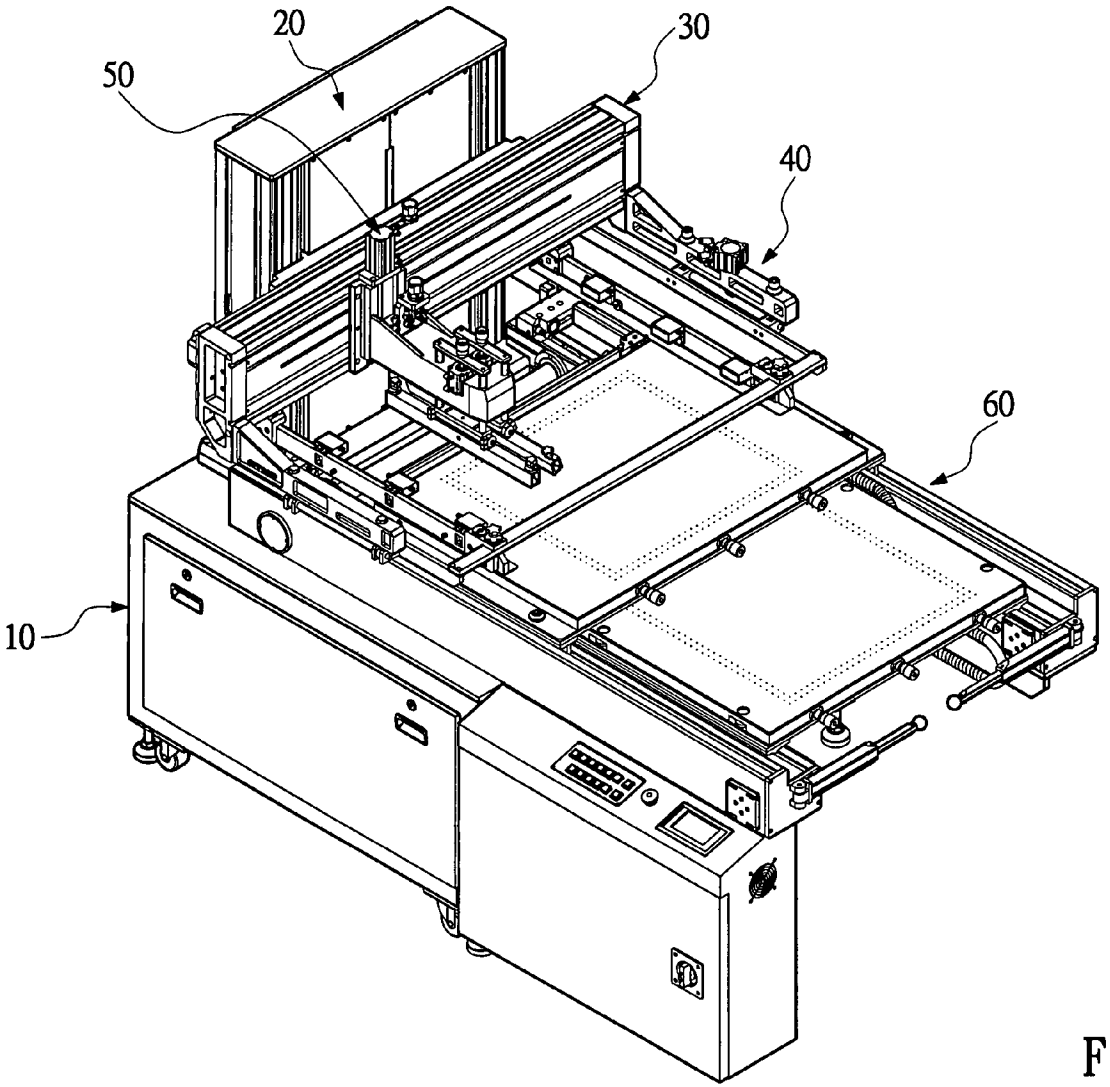
FIG. 1 is a perspective view of the present invention.

Refer to Fig. a cantilever type screen-printing machine with double platforms is mainly composed of a base 10, an elevating mechanism 20, a transverse sliding assembly 30, a chase clamping mechanism 40, a main printing mechanism 50, and a double-platform mechanism 60. The transverse sliding assembly 30 is vertically lifted by the elevating mechanism 20. And on right and left cantilever arms of the transverse sliding assembly 30 connected the chase clamping mechanism 40 which vertically moves with the transverse sliding assembly 30 synchronously. The main printing mechanism 50 that slides rightward and leftward to process printing is fitted on the transverse sliding assembly 30.

Under the main printing mechanism 50 is a double-platform mechanism 60 having an upper platform and a lower platform which are loaded with print materials and slides under the main printing mechanism 50 respectively for processing printing.

Figure 2:
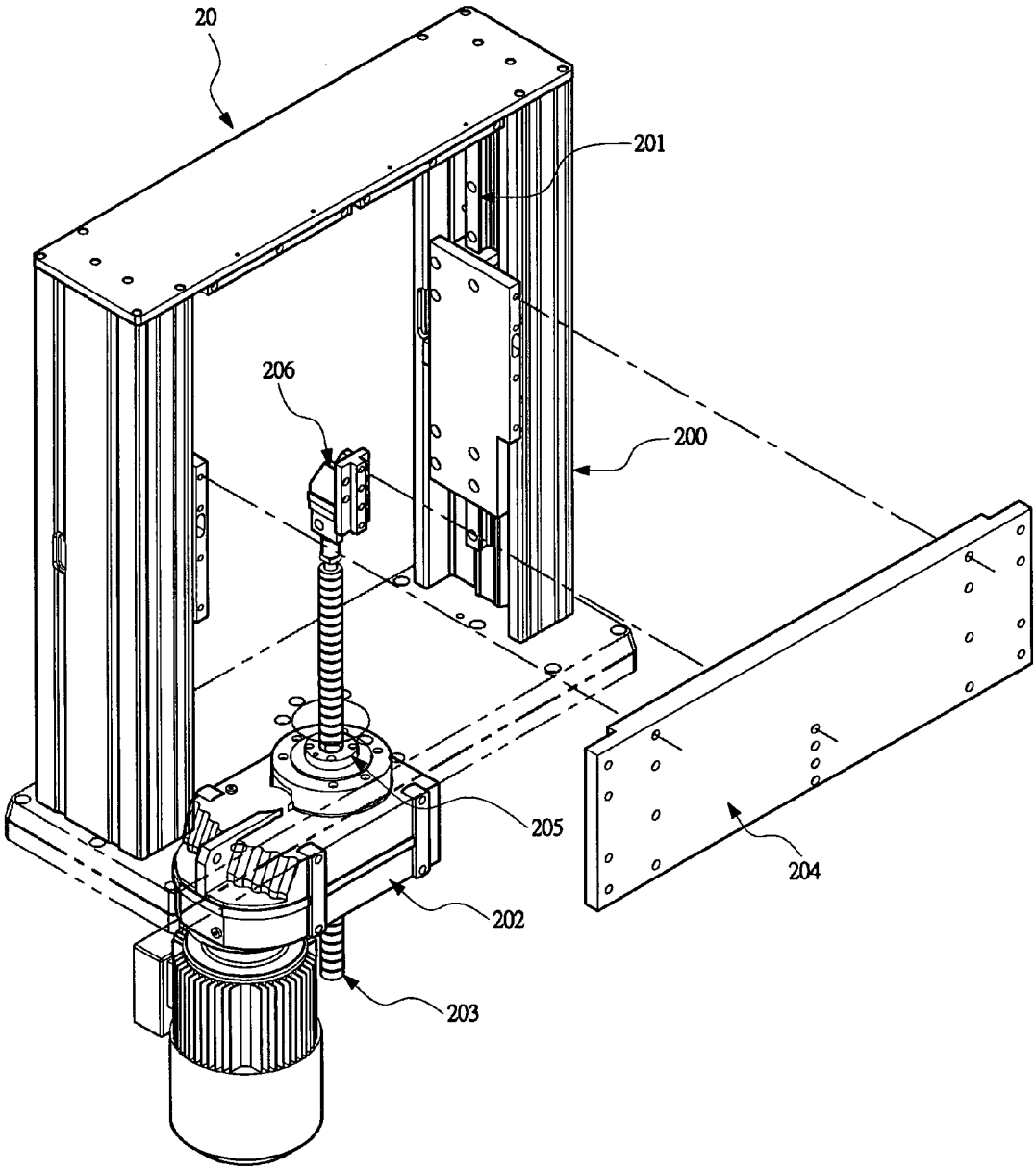
FIG. 2 is an elevating mechanism in accordance with the present invention.

With reference of FIG. 2, the elevating mechanism 20 includes right and left aluminum rectangular columns 200, each with a set of linear sliding rails 201 which is connected with a connection board 204 on inner side respectively while the connection board 204 is further connected with the transverse sliding assembly 30. A gear reducer motor 202 is fixed under the two aluminum rectangular columns as power supply resource for rotating a screw 205 of a precision threaded screw unit, thus driving a corresponding threaded rod 203 to move upward an downward without rotation inside a hollow shaft. Moreover, the threaded rod 203 is connected with the connection board 204 by a top block 206 at the upper end thereof so as to drive the transverse sliding assembly 30 synchronously with the upward and downward movement of the threaded rod 203. Furthermore, a precision coder fixed on the gear reducer motor 202 is used to record the detail movement (not shown in figure) so as to make the vertical movement of the transverse sliding assembly 30 under digital control.

Figure 3:
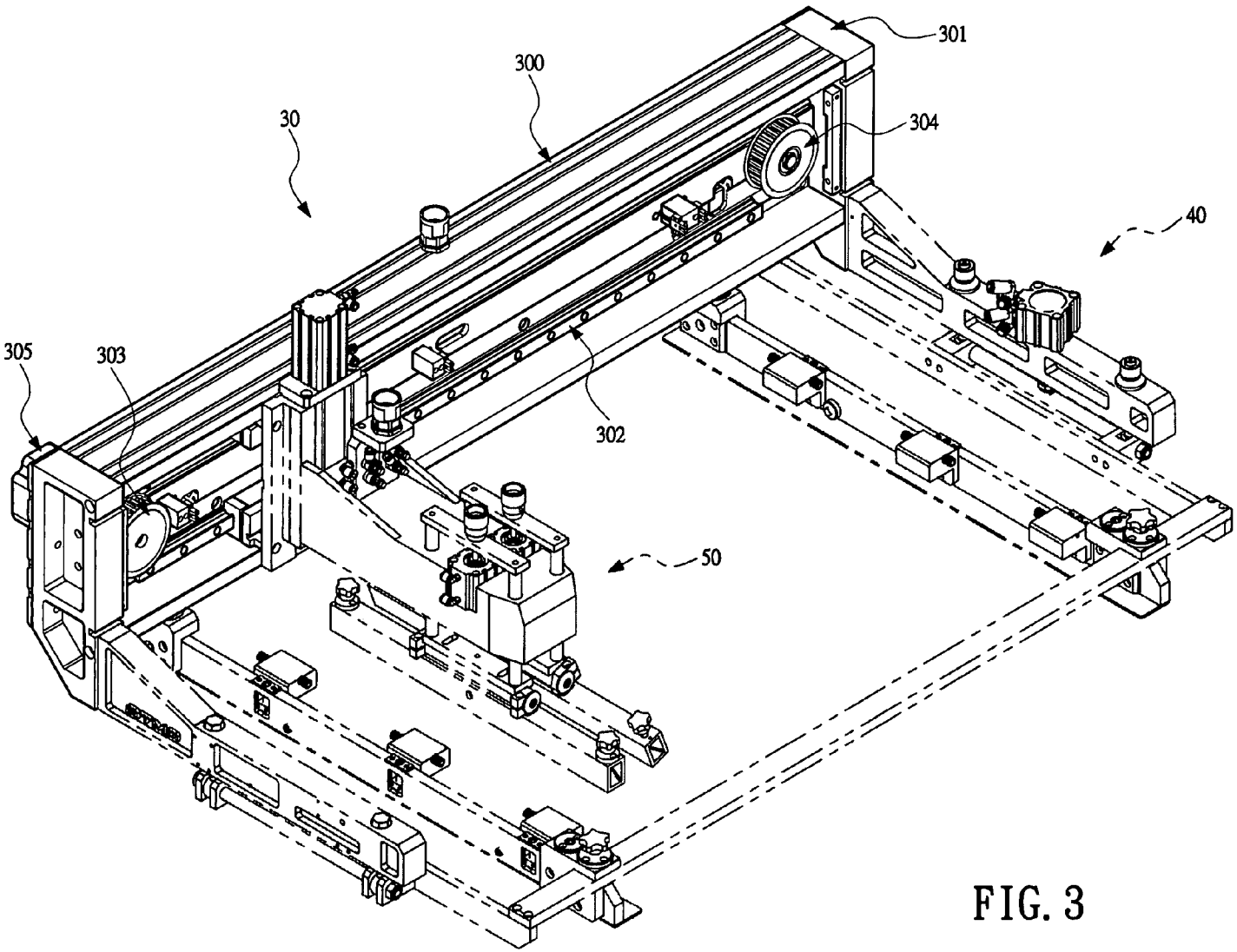
FIG. 3 is a transverse sliding assembly in accordance with the present invention.

Refer to FIG. 3, the transverse sliding assembly 30 includes a aluminum extrusion transverse column 300 with a seal block 301 on right and left ends, and a linear slide rails 302 on inner side thereof to make the main printing mechanism 50 slide back and forth along the linear slide rails 302. An active belt pulley 303 and a passive belt pulley 304 are arranged on both ends of the inner side of the transverse column 300 while the active belt pulley 303 is driven by a motor 305 so as to make the main printing mechanism 50 slide rightward and leftward by the belt.

Figure 4:
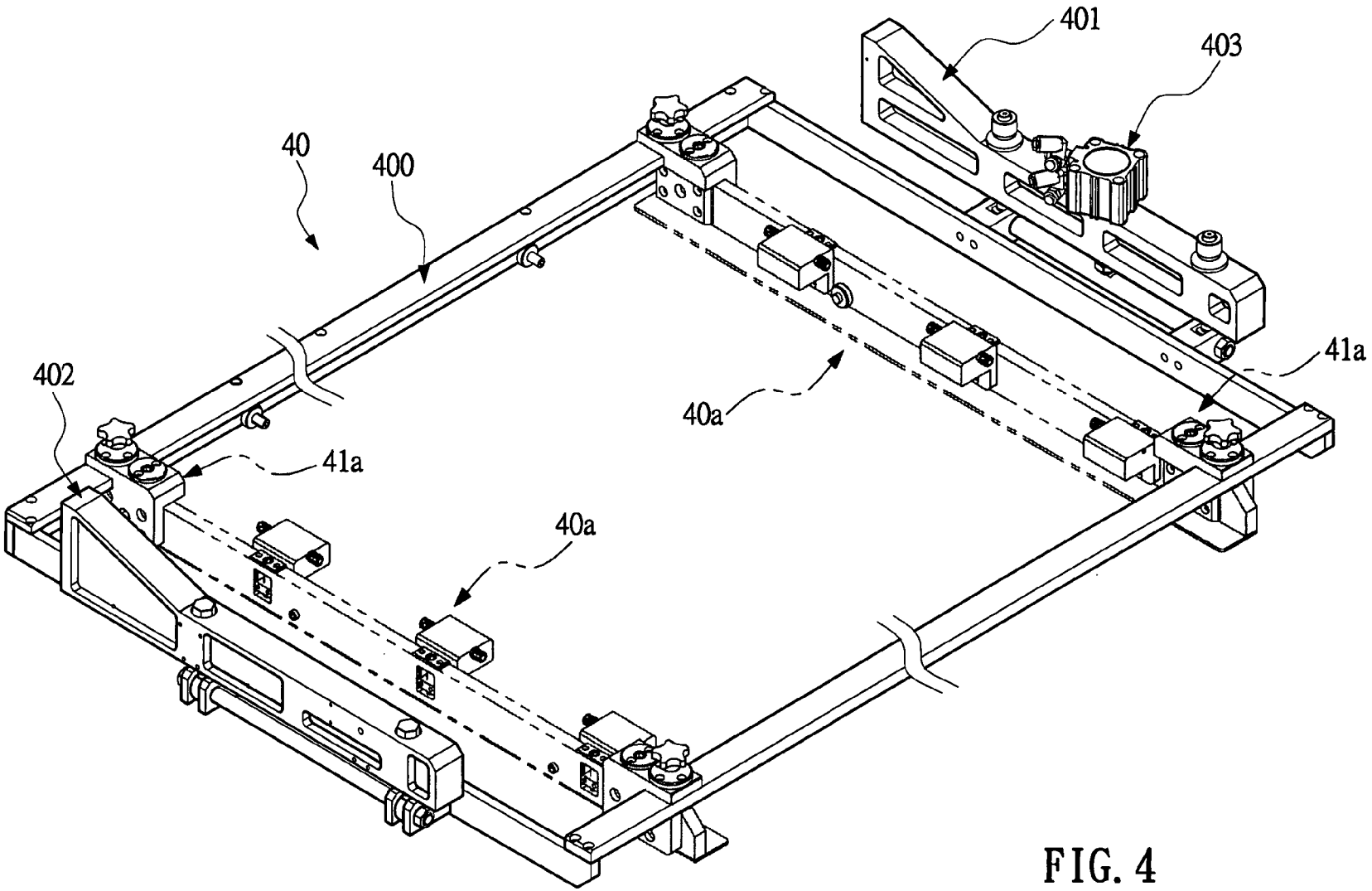
FIG. 4 is a chase clamping mechanism in accordance with the present invention.
Figure 4A:
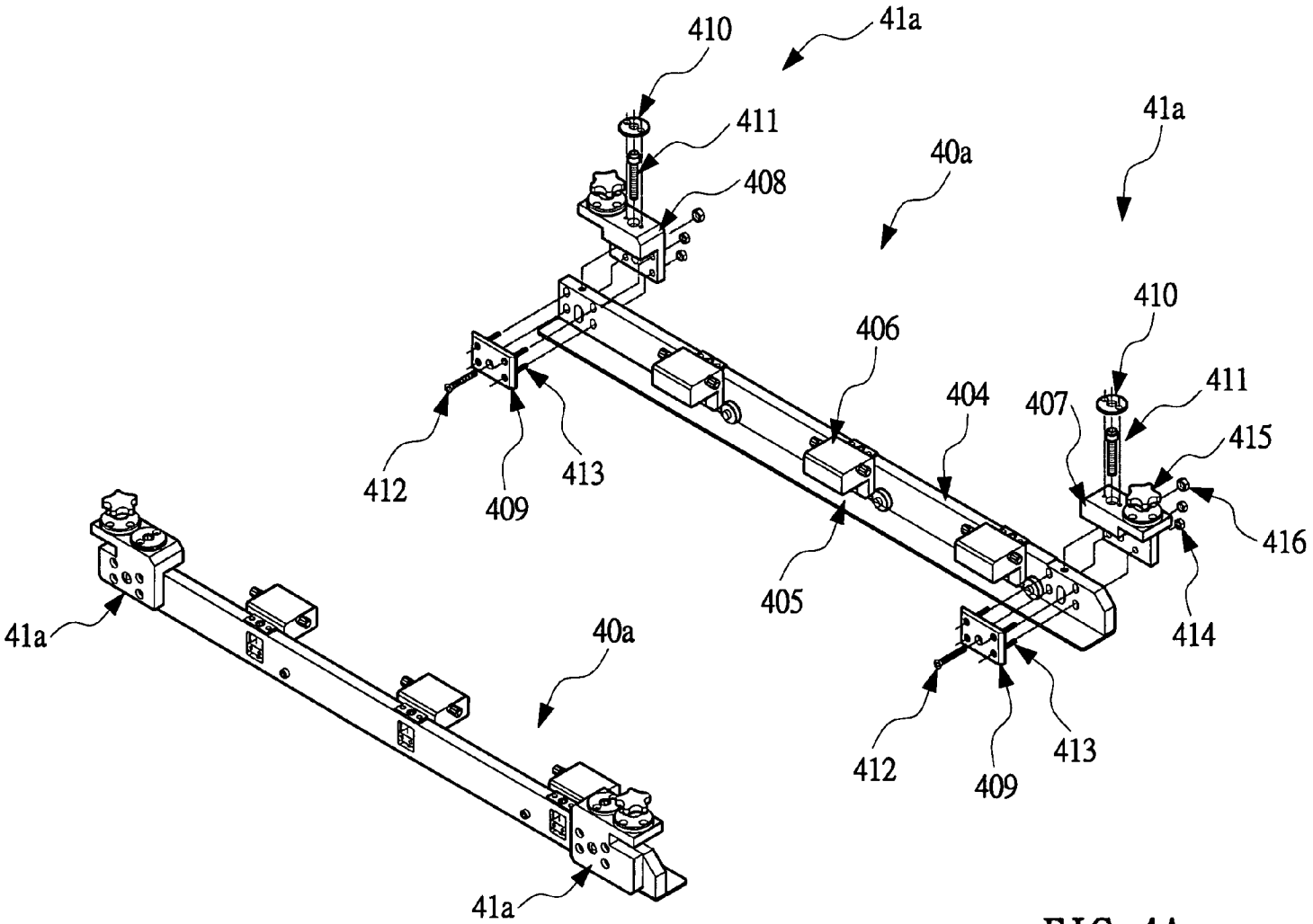
FIG. 4A is a partial explosive view of the chase clamping mechanism shown in FIG. 4.

Referring to FIG. 4–4A, the chase clamping mechanism 40 having a rectangular frame 400 and two sets of chase clamps 40*a*. Right and left sides of the rectangular frame 400 are fastened under right and left cantilever arms 401, 402 respectively. By a shifting cylinder 403 on cantilever arms 402–401 respectively, the chase is moved vertically. Furthermore, the two sets of chase clamping device 40*a* are fixed transversely on top of the rectangular frame 400 by fastening units 415 at front and rear ends thereof. The fastening units 415 can be bolts device shown on FIG. 4–4*a*, or other locking parts (not shown in figure), such as pneumatic cylinder (apply in large screen-printing machine or screen-printing machine with various chase sizes) and screws. The chase clamping device 40*a* is composed by a fixed lever 404, a holding plate 405, and a plurality of clamping pneumatic cylinder 406 for holding the rectangular frame 400 (on which mounts a chase). For mounting the screen on the screen-printing machine, firstly loosen the front and back fastening unit 415 of the chase clamping device 40*a*, then adjust the position and the distance of the two sets of chase clamping device 40*a* on rectangular frame 400, and clamp the chase by the clamping pneumatic cylinder 406 before aligning the chase and printed papers on the lower platform. When finishing alignment, the two sets of chase clamping device 40*a* are connected on the rectangular frame 400 firmly by the fastening units 415. While the chase clamping device 40*a* features on that: on both ends of the fixed lever 404 where connected with the rectangular frame 400, a vertical micro adjuster 41*a* is installed for micro-adjusting the span between the fixed lever 404 and the rectangular frame 400 after the chase being fixed. Thus the chase clamping device 40*a* and the clamped chase thereof can adjust their vertical position relating to the rectangular frame 400, keep the effect of steady distance between the chase and the platform and attain the printing quality requirement of precise printing thickness. A vertical micro adjuster 41*a* is set up in front and back end of the fixed lever 404 respectively and having a forward piece 407 and a backward piece 408, both attached with a washer plate 409 which includes a plurality of assembling screws 413 and one fastening screw 412. By a plurality of anti-loose assembling nuts 414 and an anti-loose fastening nut 416, the washer plate 409 is fastened on the fixed lever 404. Furthermore, holes on the fixed lever 404 for assembling screws 413 and fastening screw 412 are vertical long narrow hole so that the forward and the backward piece 407–408 can vertically adjust in proper position.

Fastening units 415 are fitted on the outer side of the forward and the backward piece 407–408 for fixing the chase clamping device 40*a* on the rectangular frame 400. Moreover, a horizontal adjusting bolt 411 and a washer 410 are arranged in the inner surface side of the forward and the backward piece 407–408 and are fixed on top of the fixed lever 404 through a hole in the forward and the backward piece 407–408. In addition, the washer 410 screwed on the horizontal adjusting bolt 411 to cover on the hole prevents the screwed horizontal adjusting bolt 411 from loosening off. The horizontal adjusting bolt 411 (can be hexagonal bolt) can not be shifted thus causes the fixed lever 404 to shift vertically and attain the vertical micro-adjustment function on the distance between the fixed lever 404 and the rectangular frame 400 so that make the micro-adjust effect between the chase and printing matters.

The assembling screws 413 and the anti-loose assembling nuts 414 can connected closely, but can be shifted without hamper the vertical movement of the fixed lever 404 while adjusting the horizontal adjusting bolt 411.

Referring to FIGS. 5–6–6A–6B–6C, the double-platform mechanism 60 mainly includes a right and a left runner tracks 601–602, an upper and a lower platforms 604–608, a homocentric coaxial shaft 61, and two gear reducer motors 620 wherein the right and the left runner tracks 601–602 fixed on the right and the left sides of the base 10 where a supporting sliding track 626 and a gear sliding belt 627 with different altitude are accommodated therein while the right and the left sides of the upper and the lower platforms 604–608 are connected with the gear sliding belts 627 by the sliding connection bars 605–606 and slide forward and backward along the supporting sliding track 626. Moreover, the homocentric coaxial shaft 61 having an inner shaft 611 fitted in an outer shaft 610 is arranged transversely on the rear portion of the right and the left runner track 601–602. Outer and inner bearings 613–614 are fixed at both ends of the outer shaft 610 and the inner shaft 611 for supporting. Furthermore, on two sides of the outer shaft 610 and far beyond the inner shaft 611, two passive belt pulleys 617–618 powered and driven by the respective gear reducer motor 620 are set there respectively. The outer shaft 610 and the inner shaft 611 rotate respectively. In addition, the two gear reducer motors 620 are fixed with a coder 622 respectively in order to control the inner and the outer shafts 610–611 and attain the effect of PLC control accordingly. Thereafter, the gear reducer motor 620 could be replaced by a normal motor, a stepping motor, a servo motor, etc. in combination with other control mechanisms so as to have the same function as the gear reducer motor 620. And the above-mentioned belt pulleys such as active belt pulleys 621, passive belt pulleys 617–618, can also be replaced by other equivalent products such as geared belt pulleys, general belt pulleys or chain pulleys.

At run, the double-platform mechanism 60 uses the two gear reducer motors 620 to drive outer and inner shafts 610–611 respectively so that the inner and the outer shafts can rotate in various modes such as both shafts runs simultaneously in the reverse rotate direction, or in the same rotate direction, or different rotate speed for the inner and outer shafts respectively, or only one shaft rotates, etc. Thus makes the upper and the lower platforms 604–608 shift back and forth reciprocally, or simultaneously, or single platform shifting, etc. so as to apply the two platforms 604–608 for different requirements by adjusting different shifting types. For example, while in large volume printing process, the two platforms 604–608 are adjusted into reciprocal shift printing type so as to print at the same time and spend no idle time for preparing printing materials thus increase the sliding speed and print productivity. If only a small amount of printing is processing, an upper platform 604 is used for shifting and printing.

The double-platform mechanism 60 further having a magnetic buffer 63, an X axis micro adjuster 65, a Y axis platform micro adjuster 66, an ink scraper 67, or a platform aspirator 68 so as to achieve more accurate printing effect. Or optionally add a safety lever 64 for safety sake.

Referring to FIGS. 1–5–6, the magnetic buffer 63 is set on the rear end of the right and the left runner tracks 601–602. The magnetic buffer 63 includes a fixed block 631 with a magnetic iron 632 and an oil hydraulic buffer 633 thereon while the positions of the magnetic iron 632 and the oil hydraulic buffer 633 correspond to the left and right sides of the upper and the lower platforms 604–608 respectively. Thus the rapid movement of the upper and the lower platforms 604–608 can be halted when approaching the stop position of the printing by the assistance of the oil hydraulic buffer 633 taking in momentum of quick stop and efficient control the shaking phenomenon of instant stop as well as the function of the magnetic iron 632 for assuring that the platforms 604–608 can precisely go back and stop at the right position for each movement. The type of oil hydraulic buffer 633 can be changed into a pneumatic cylinder buffer, or other devices with same function as shaking absorbing effect. In addition, the magnetic buffer 63 can fix either at the rear side as shown by the figure, or at the front end for material feeding.

Figure 7B:
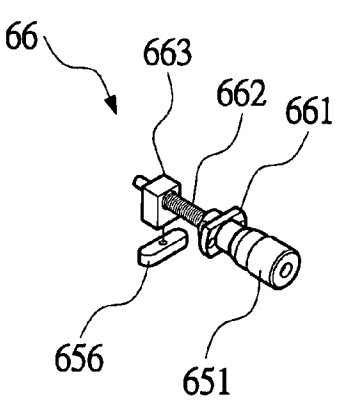
FIG. 7B is a partial explosive view of the Y axis micro adjusters in FIG. 7.
Figure 7A:
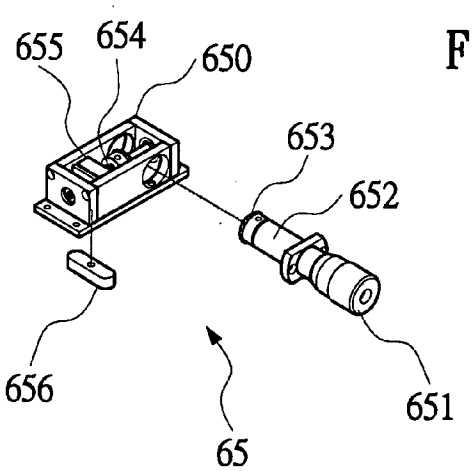
FIG. 7A is a partial explosive view of the X axis micro adjusters in FIG. 7.
Figure 7:
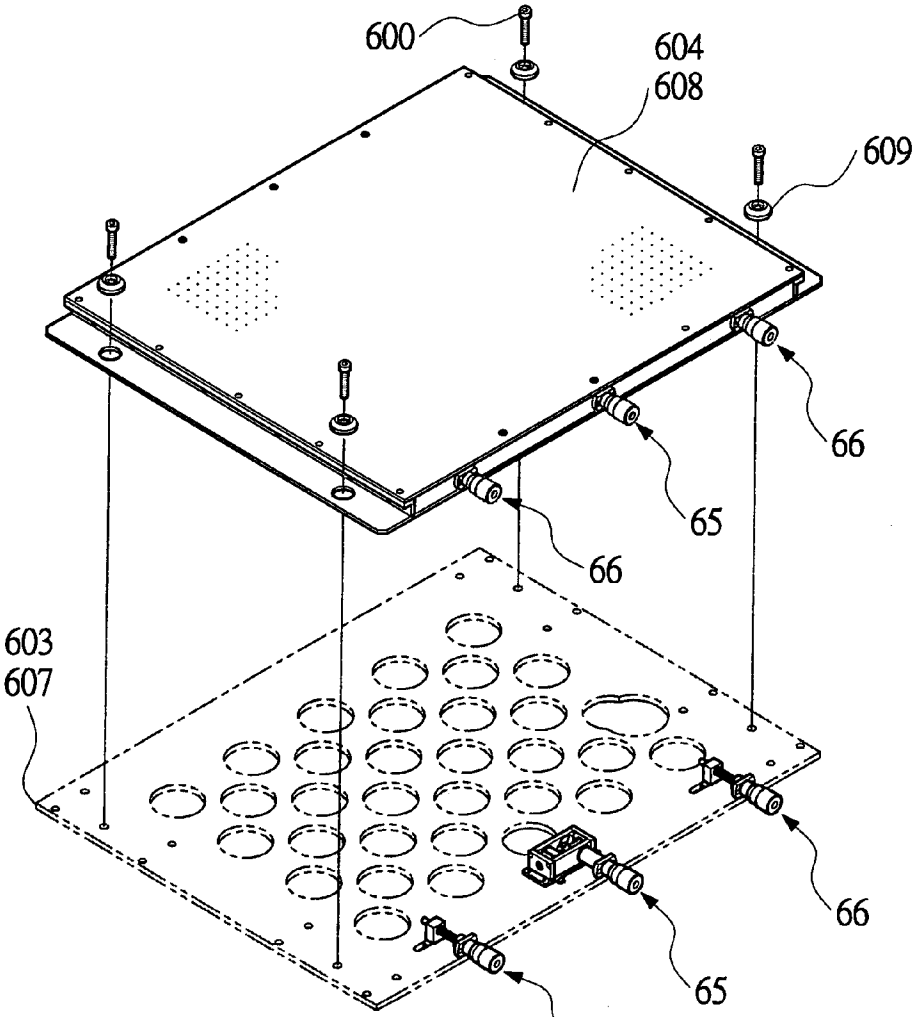
FIG. 7 is an explosive view of micro adjusters in accordance with the present invention.

Referring to FIGS. 7–7A–7B, the X axis micro adjuster 65 and the two Y axis micro adjuster 66 are fixed under the upper and the lower platforms 604–608, between the platform surface 604(608) and a bottom plate 603(607), wherein the X axis micro adjuster 65 arranged in the center of the front end of the platform 604(608) is primary combined from a knob 651, a bevel gear set (right angle gear set) 650, and a gear block 656 which is mounted on the bottom plate 603(607). When process micro adjustment, roll the knob 651 to drive the bevel wheel 653 of the bevel gear set 650 through the knob fixed part 652. Then the passive bevel wheel 654 of X axis is rotated and thus driving the gear block 656 moving in X axis direction (rightward and leftward) by the threaded rod and a block fixed part 655 so as to have the X axial relative shift between the platform 604(608) and the bottom plate 603(607) as well as attain the effect of X axial adjustment. The two Y axis platform micro adjusters 66 are fitted on left and right sides of the X axis micro adjuster 65 and each having a knob 651, a knob fixed part 652, a micro adjust threaded bar 662, a block fixed device 663, and a gear block 656 mounted on the bottom plate 603(607). When process micro adjustment, roll the knob 651 to drive the micro adjust threaded bar 662 through the knob fixed part 652 and then drive the block fixed device 663 and the gear block 656 to progress in Y axis direction (forward and backward) thus have Y-axial relative shift between the platform 604(608) and he bottom plate 603 (607) and achieve the effect of Y axial adjustment. By use of the dual adjustment of the X axis micro adjuster 65 in the platform center and two Y axis platform micro adjuster 66 on both sides of the platform, the results of unitary X axis or Y axis micro adjustment, or dual directions micro adjustment of X-Y axis(two points or multiple points of X-Y axis on a 90° plane angle), or ⊖ degree of circumvention adjustment are achieved.

Refer to FIGS. 5–6–6B–6C, After finished printing process, the chase left by the cantilever arms 40, then the ink scraper 67 rise a scraper groove 678 to the chase bottom and scrape away redundant ink on the chase bottom. The ink scraper 67 are fixed on right and left sides of the rear portion of the upper platform 604 by the two cylinder fixed plates 671, each with a cylinder 673. By a fixed clench bar 670, the cylinder 673 is connected with the gear block 672. Thus the two gear blocks 672 are stretched by two cylinders 673 to make the fixed clench bar 670 stretched up and down by the control of cylinder 673. In addition, the scrape groove 678 screwed firmly by two manual bolts 675 on both ends of the fixed clench bar 670 can be assembled and disassembled conveniently for cleaning the ink therein. Moreover, a micro adjust bolt 674 is set up between the fixed clench bar 670 and the two gear blocks 672 at both end respectively for vertical adjustment of the fixed clench bar 670 as well as precise control of the contact between the scrape groove 678 and the chase bottom. Furthermore, the cylinder 673 can be other type of vertical adjustment mechanism, whatever can perform the scrape groove's action will be accepted.

Figure 6:
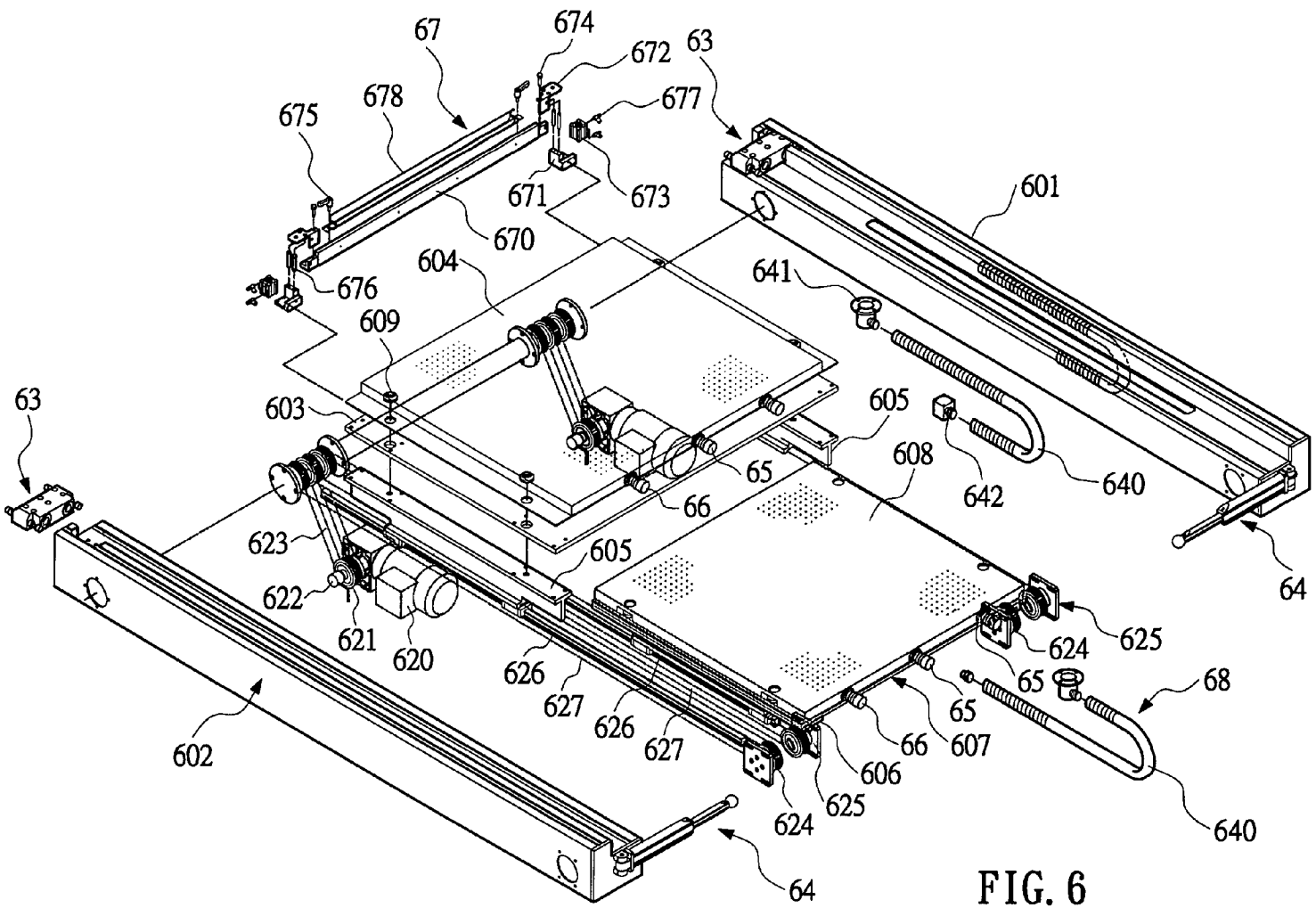
FIG. 6 is an explosive view of FIG. 5.
Figure 6A:
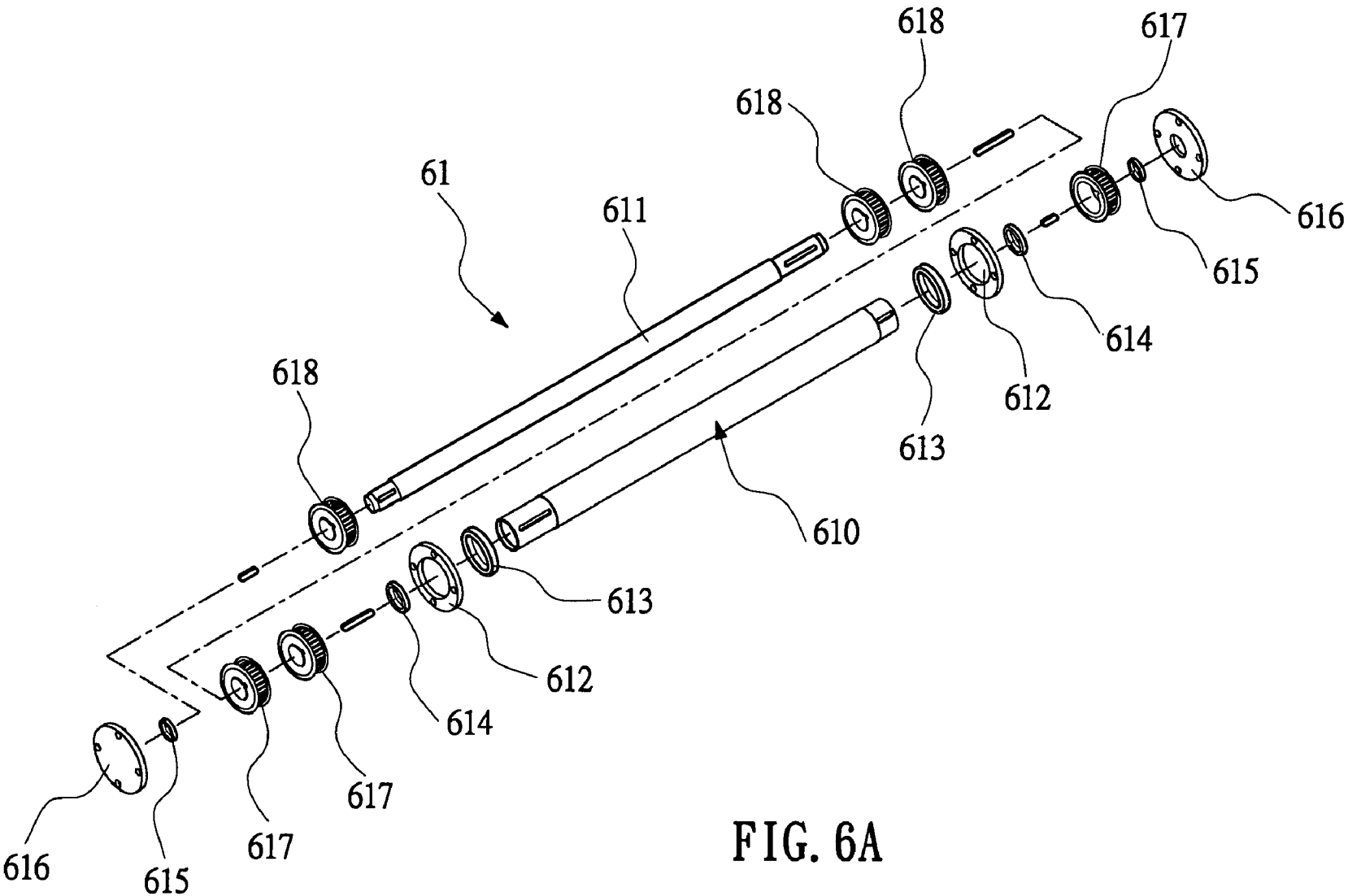
FIG. 6A is an explosive view of the homocentric coaxial shaft in FIG. 5.
Figures 6B, 6C:
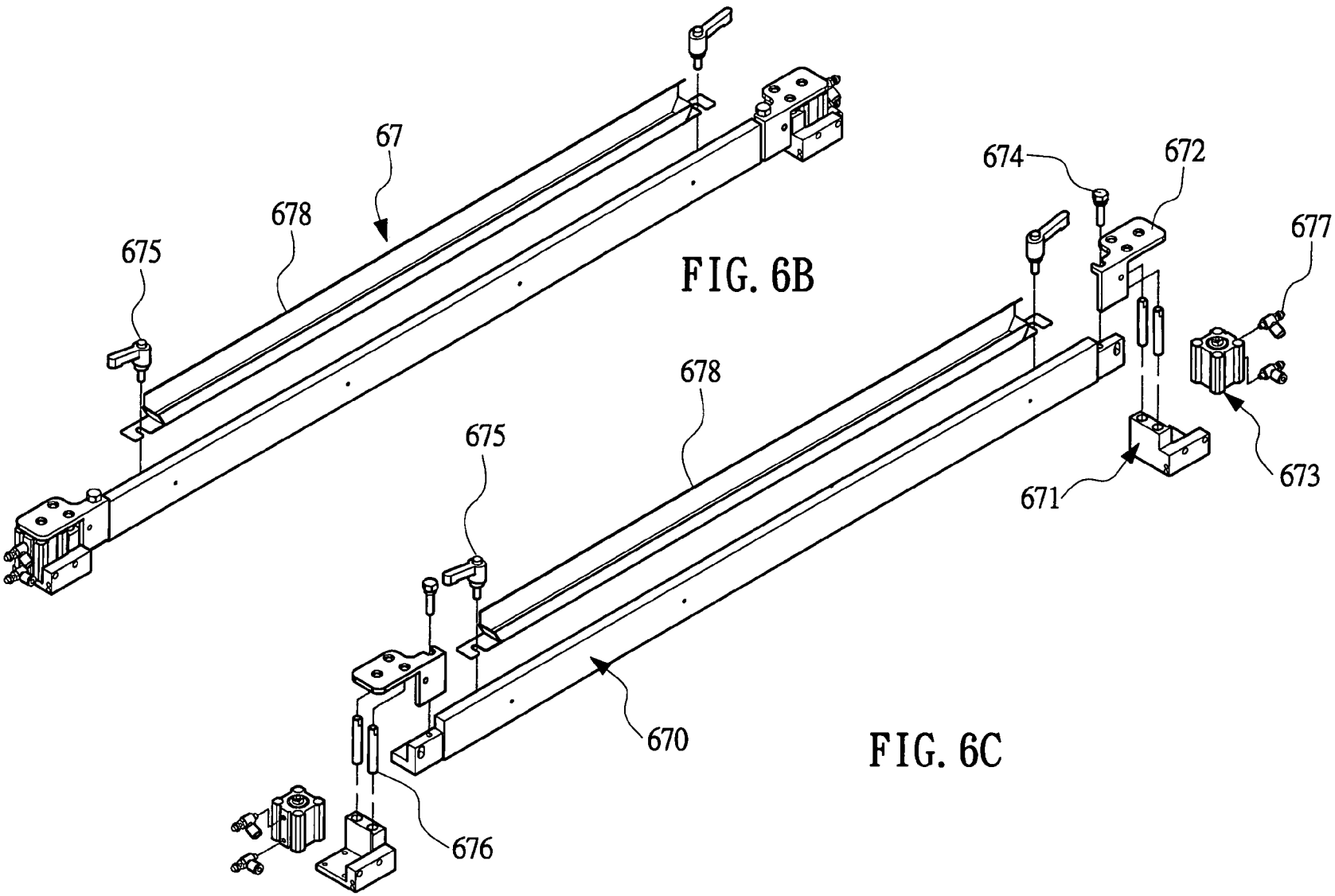
FIG. 6B is a schematic drawing of the ink scraper in FIG. 5.
FIG. 6C is an explosive view of the ink scraper in FIG. 5.

Referring to FIG. 6, the platform aspirator 68 locates at the platform 604–608 to attach the print materials in right position and avoid print materials shifting in printing process. The platform aspirators 68 are arranged under double platforms respectively and each possesses a connection joint 641 with a suction hose 640 which is connected to a suction device (not shown) with the other connection joint 642. The suction hose 640 of the upper platform 604 is fixed at the middle side of the right runner track 601, while the suction hose 640 of the lower platform 608 is fixed thereunder so that the two suction devices 68 will not interfere with each other when the two platforms run reciprocally, that is, the suction devices could suck at the same time, or the one sucks while the other blows at a time.

Figure 5:
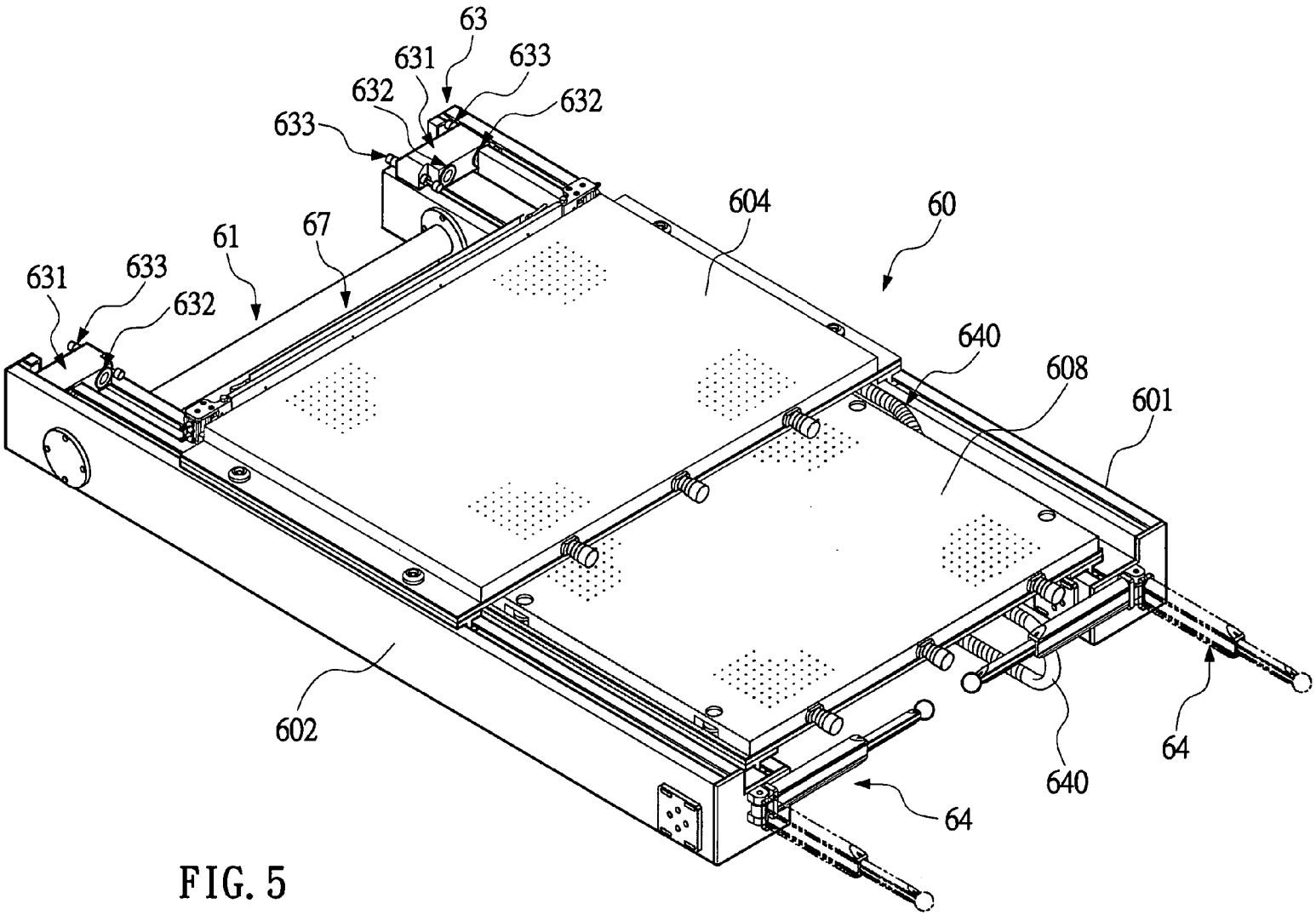
FIG. 5 is a double platform mechanism in accordance with the present invention.

Referring to FIGS. 1–5–6, within the sliding range and in front of the two platforms 604–608 are fixed with two safety lever 64 which consists of a right lever and a left lever. Once one of the levers 64 is swing open as shown in FIG. 5, power will be off immediately to avoid operators being hit by the running platform within the sliding range, and therefore increase the safety of operation environment.

What is claimed is:

1. A cantilever type screen-printing machine with double platforms comprising a base, an elevating mechanism, a transverse sliding assembly, a chase clamping mechanism, a main printing mechanism, and a double-platform mechanism;

the transverse sliding assembly is lifted vertically by the elevating mechanism and the chase clamping mechanism that vertically moves with the transverse sliding assembly synchronously are connected with the right and the left cantilever arms of the transverse sliding assembly; while the main printing mechanism on the transverse sliding assembly slides rightward and leftward to process printing; the double-platform mechanism having an upper platform and a lower platform which are loaded with print materials and slide under the main printing mechanism respectively for processing printing;

wherein the elevating mechanism includes right and left aluminum rectangular columns, each with a set of linear sliding rails which is connected with a connection board that is joined with the transverse sliding assembly on inner side respectively; a gear reducer motor with a hollow shaft is fixed under the two aluminum rectangular columns for rotating a screw of a precision threaded screw unit, thus driving a corresponding threaded rod to move vertically without rotation inside the hollow shaft; while the top of the threaded rod is connected with the connection board by a top block so as to drive the transverse sliding assembly synchronously;

the transverse sliding assembly having an aluminum extrusion transverse column with linear slide rails on inner side thereof to make the main printing mechanism slide back and forth along the linear slide rails; an active belt pulley driven by a motor and a passive belt pulley are arranged on left and right ends of the inner side of the transverse column for driving the main printing mechanism transversely;

the chase clamping mechanism having a rectangular frame and two sets of chase clamps; the right and left sides of the rectangular frame are fastened under right and left cantilever arms respectively while the two sets of chase clamping device are fixed transversely on top of the rectangular frame by fastening units at front and rear ends thereof; the chase clamping device having a fixed lever, a holding plate, and a plurality of clamping pneumatic cylinder for holding the chase; on both ends of the fixed lever, where connected with the rectangular frame, a vertical micro adjuster is installed for micro-adjustment that includes a forward piece and a backward piece, both attached with a washer plate which includes a plurality of assembling screws and one fastening screw; by a plurality of anti-loose assembling nuts and an anti-loose fastening nut, the washer plate is fastened on the fixed lever; holes on the fixed lever for assembling screws and fastening screw are vertical long narrow hole so that the forward and the backward piece adjust in proper position vertically; a horizontal adjusting bolt and a washer are arranged in the surface of the forward and the backward piece and are fixed on top of the fixed lever through a hole in the forward and the backward piece; the washer screwed on the horizontal adjusting bolt to cover on the hole prevents the screwed horizontal adjusting bolt from loosening off; by rotating the horizontal adjusting bolt, the fixed lever shifts vertically thus micro-adjusting the distance between the fixed lever and the rectangular frame;

the double-platform mechanism includes a right and a left runner tracks, an upper and a lower platforms, a homocentric coaxial shaft, and two gear reducer motors while the right and the left runner tracks fixed on the right and the left sides of the base and a supporting sliding track as well as a gear sliding belt with different altitude are accommodated therein; the right and the left sides of the upper and the lower platforms are connected with the gear sliding belts by the sliding connection bars and slide forward and backward along the supporting sliding track; the homocentric coaxial shaft having an inner shaft fitted in an outer shaft is arranged transversely on the rear portion of the right and the left runner track while outer and inner bearings are fixed at both ends of the outer shaft and the inner shaft for supporting; on two sides of the outer shaft and far beyond the inner shaft, two passive belt pulleys powered and driven by the respective gear reducer motor are set there respectively; the outer shaft and the inner shaft rotate are driven by the two gear reducer motors respectively so that the inner and the outer shafts can rotate in various modes such as both shafts runs simultaneously in the reverse rotate direction, or in the same rotate direction, or different rotate speed for the inner and outer shafts respectively, or only one shaft rotates, thus the upper and lower platforms shift back and forth reciprocally, or simultaneously, or single platform shifting for different requirements of printing.

2. The cantilever type screen-printing machine with double platforms as claimed in claim 1, wherein the gear reducer motors of the elevating mechanism are used in combination with a coder.

3. The cantilever type screen-printing machine with double platforms as claimed in claim 1, wherein the fastening units at front and rear ends of the chase clamping device are bolts, pneumatic cylinders or screws.

4. The cantilever type screen-printing machine with double platforms as claimed in claim 1, wherein the gear reducer motor of the double-platform mechanism is a normal motor, a stepping motor, or a servo motor.

5. The cantilever type screen-printing machine with double platforms as claimed in claim 1, wherein the belt pulley of the double-platform mechanism is a geared belt pulley, a general belt pulley or a chain pulley.

6. The cantilever type screen-printing machine with double platforms as claimed in claim 1, wherein the double-platform mechanism further having a magnetic buffer that is set on the rear end of the right and the left runner tracks; the magnetic buffer includes a fixed block with a magnetic iron and a buffer thereon while the positions of the magnetic iron and the buffer correspond to the left and right sides of the upper and the lower platforms respectively; when the upper and the lower platforms move rapidly, both can be halted when approaching the stop position of the printing by the assistance of the buffer taking in momentum of quick stop as well as the function of the magnetic iron for assuring that the platforms can precisely go back and stop at the right position for each movement.

7. The cantilever type screen-printing machine with double platforms as claimed in claim 6, wherein the buffer is an oil hydraulic buffer or pneumatic cylinder buffer.

8. The cantilever type screen-printing machine with double platforms as claimed in claim 1, wherein the double-platform mechanism further having a X axis micro adjuster and two Y axis micro adjuster, both fixed under the upper and the lower platforms, between the platform surface and a bottom plate, while the X axis micro adjuster arranged in the center of the front end of the platform further having a knob, a bevel gear set, and a gear block; by rolling the knob, the passive bevel wheel of X axis is rotated and thus driving the gear block moving in X axis direction so as to have the X axial relative shift between the platform and the bottom plate; the two Y axis platform micro adjusters are fitted on left and right sides of the X axis micro adjuster and each having a knob, and a micro adjust threaded bar and a gear block; by rolling the knob, the micro adjust threaded bar drives the gear block to progress in Y axis direction (forward and backward) thus have Y-axial relative shift between the platform and the bottom plate.

9. The cantilever type screen-printing machine with double platforms as claimed in claim 1, wherein the double-platform mechanism further having an ink scraper fixed on right and left sides of the rear portion of the upper platform, while a fixed clench bar is stretched up and down by the right and left cylinders; a scrape groove is screwed firmly by two manual bolts on both ends of the fixed clench bar so that the scrape groove moves vertically with the fixed clench bar.

10. The cantilever type screen-printing machine with double platforms as claimed in claim 9, wherein a micro adjust bolt is disposed at both end of the fixed clench bar respectively for vertical adjustment of the fixed clench bar as well as the scrape groove.

11. The cantilever type screen-printing machine with double platforms as claimed in claim 1, wherein the double-platform mechanism further having platform aspirators arranged under the two platforms respectively and each possesses a connection joint with a suction hose that is connected to a suction device with the other connection joint; the suction hose of the upper platform is fixed at the middle side of the right runner track, while the suction hose of the lower platform is fixed thereunder so that the two suction devices 68 will not interfere with each other when the two platforms run reciprocally.

12. The cantilever type screen-printing machine with double platforms as claimed in claim 1, wherein the double-platform mechanism further having a safety lever arranged on the sliding range and in front of the two platforms; the safety lever having a right lever and a left lever while each is swing open, the platform stops.

* * * * *